United States Patent [19]

Houseman et al.

[11] 4,356,765

[45] Nov. 2, 1982

[54] STRIP REEL AND PRINTING APPARATUS

[75] Inventors: J. Daniel Houseman; Sydney C. Fluke, both of Topeka, Kans.

[73] Assignee: Brackett, Inc., Topeka, Kans.

[21] Appl. No.: 253,064

[22] Filed: Apr. 10, 1981

[51] Int. Cl.[3] ..... B41F 13/04; B41F 13/50

[52] U.S. Cl. ..... 101/228; 101/92; 101/178; 101/247

[58] Field of Search ..... 101/228, 219, 181, 182, 101/92, 91, 90, 178, 247

[56] References Cited

U.S. PATENT DOCUMENTS

| | | | |
|---|---|---|---|
| 2,646,104 | 7/1953 | Hawkes . | |
| 2,893,310 | 7/1959 | Johnson | 101/182 |
| 3,204,556 | 9/1965 | Slavic | 101/228 |
| 3,242,854 | 3/1966 | Ritzerfeld et al. | 101/91 |
| 3,304,862 | 2/1967 | Lawrence et al. | 101/182 X |
| 3,668,037 | 6/1972 | Blair . | |
| 3,804,694 | 4/1974 | Blair . | |
| 3,920,501 | 11/1975 | Carlton et al. . | |
| 4,019,617 | 4/1977 | Englund et al. | 101/91 X |
| 4,073,231 | 2/1978 | Roser | 101/90 X |
| 4,151,037 | 4/1979 | Klingelhoefer et al. . | |
| 4,166,300 | 9/1979 | Savich . | |

*Primary Examiner*—J. Reed Fisher

*Attorney, Agent, or Firm*—Litman, Day & McMahon

[57] ABSTRACT

A combination strip reel and printing apparatus and method for printing a headband strip includes a frame with a reel holder and strip tension maintaining dancer tubes positioned in the strip feed path on each side of a printing mechanism. The printing mechanism is an interval printer with a plate wheel and an impression wheel which swings the strip in and out of printing contact with the plate wheel in response to the operation of start and stop switches selectively positionable relative to the plate wheel. The plate wheel turns at a constant speed and the impression wheel and arms holding the impression wheel and the strip move to alternately start and stop rotation of the impression wheel. The arms swing the strip and impression wheel into and out of printing engagement with the plate wheel. The printing interval is completely adjustable between the circumferential length of the plate wheel and the length of a selected character on the plate wheel.

4 Claims, 15 Drawing Figures

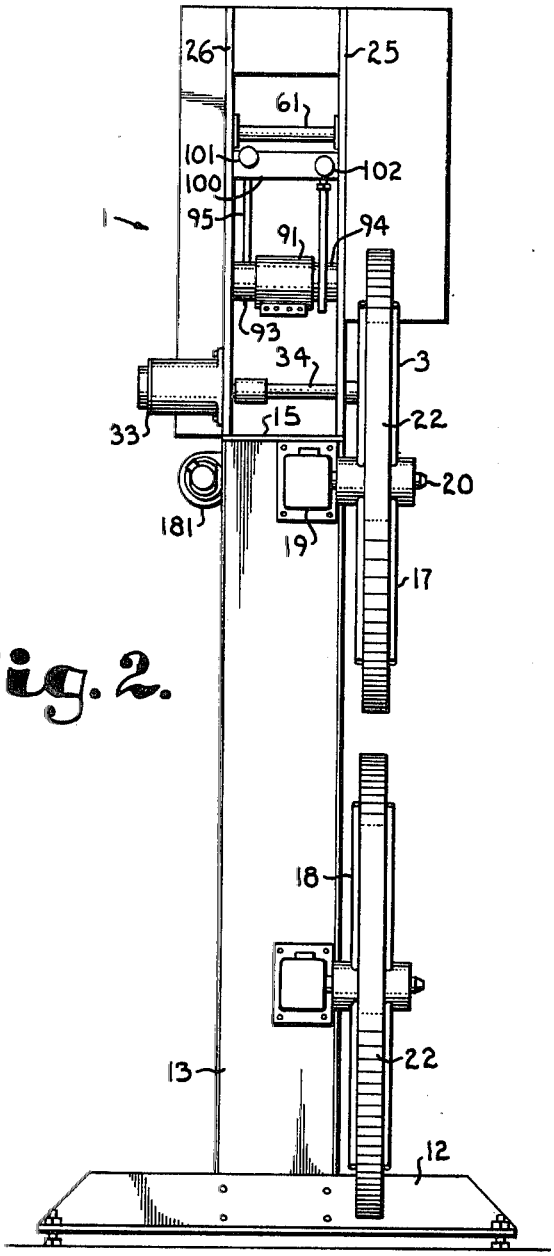
Fig. 2.
Fig. 12.
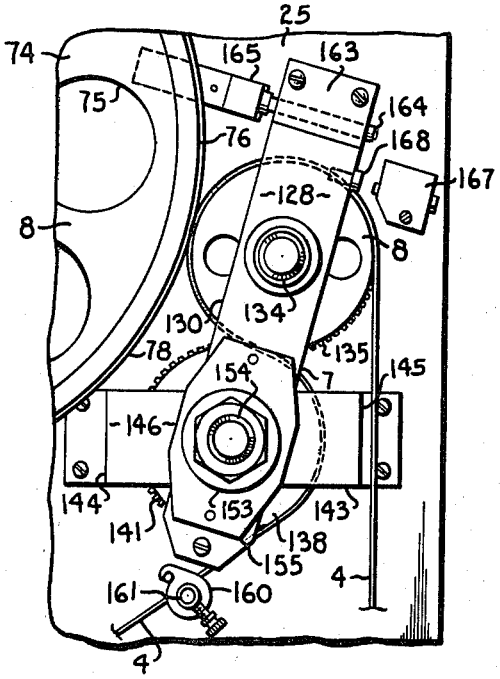
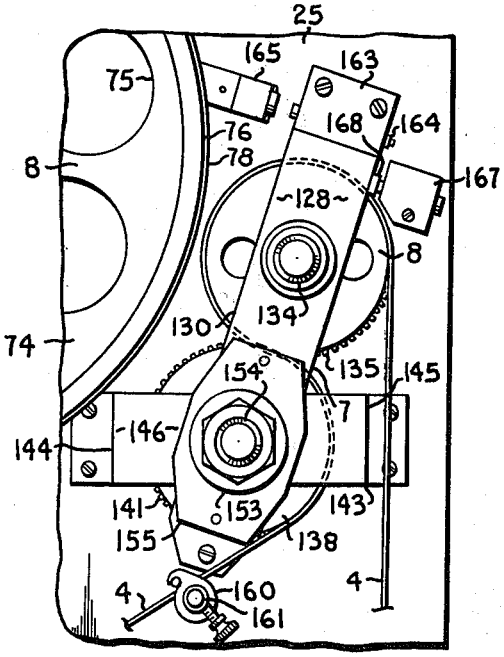
Fig. 13.
Fig. 14.
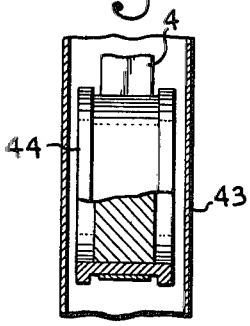

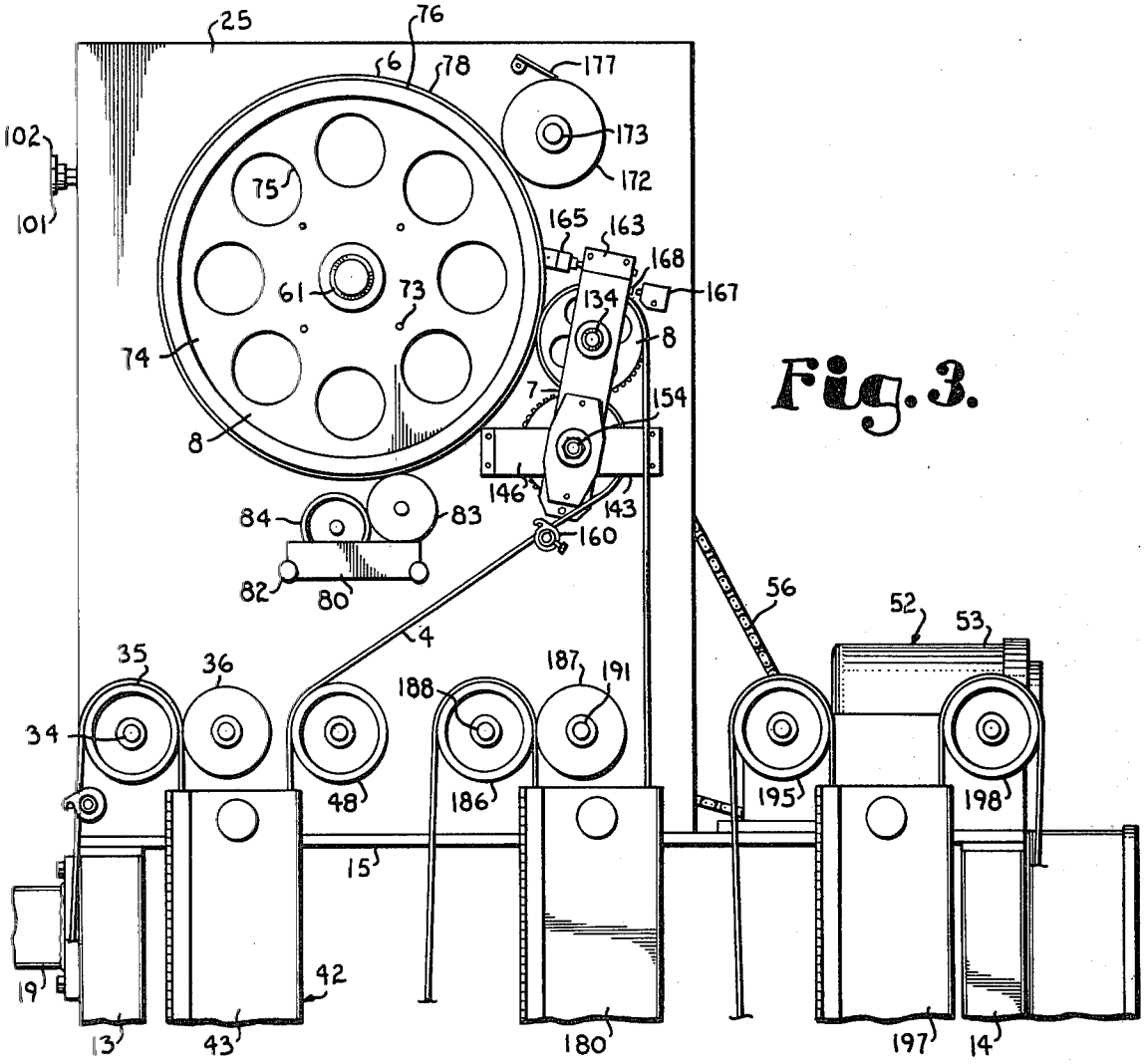
Fig. 3.
Fig. 7.
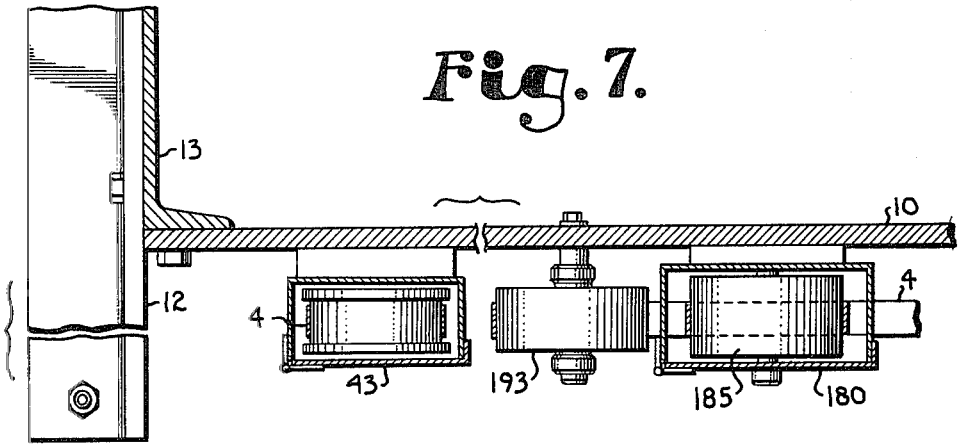

STRIP REEL AND PRINTING APPARATUS

This invention relates to a strip reel for headband strips and in particular to a combination strip reel and printing apparatus and method for feeding printed strips to tablet machines and the like.

BACKGROUND OF THE INVENTION

In the making of tablets, a plurality of sheets of paper are arranged into a set with the edges of the sheets in registration. The sets are moved in a defined path and one edge held together by applying a cement or adhesive. A headband strip is applied to the cemented edge and a length of tape applied to secure the headband strip to the tablet set. Finally, the sets are cut into predetermined lengths such as 8½ by 14 inches, 6 by 8 inches and the like.

Devices for producing tablets are commonly known as tablet machines, such as shown in the U.S. Pat. No. 3,668,073 issued to Boyd C. Blair and assigned to the Brackett Stripping Machine Company, Inc.; this patent is incorporated by reference herein. The headband strips are typically of cardboard or heavy paper and have heretofore been formed in large sheets, printed in sheet form and sliced into individual strips which are hand fed into the tablet machine. This method is time consuming and labor intensive, and hence is costly.

In view of the above, the present invention provides a combination headband strip reel and printer for use with a tablet machine. The printing mechanism is adjustable to selectively set an interval of print so that a single printing plate or plate wheel can be used to print headbands of virtually any length used on standard size or special order tablets, thereby alleviating the usual necessity for expensive, different length printing plates and the set up times attendent thereto to change from the production of one tablet size to another.

OBJECTS OF THE INVENTION

The principle objects of the present invention are: to provide a combination strip reel and headband printing apparatus and method; to provide a printing mechanism in which the length of a printed portion on the headband strip can be varied to suit production needs; to provide a printing mechanism in which the length of a printed portion can be varied without any necessity to change the printing plate wheel; to provide a printing mechanism in which an impression wheel is selectively timed and actuated to move into and out of printing contact with a plate wheel; to provide a printing mechanism in which adjustment and printing intervals setting is easily and quickly accomplished; to provide a printer having a means to take up slack in the headband strip as the strip is fed through the printing mechanism at intervals to maintain a smoothly flowing feed path; to provide a printer having a dryer unit therewith to set the ink; to provide a method for printing a headband strip involving rotating a plate wheel at a constant speed and running the strip thereby in adjustably predetermined intervals; and to provide such a strip reel and printing apparatus and method which is sturdy and efficient in use and particularly well adapted for the intended purpose.

Other objects and advantages of this invention will become apparent from the following description taken in connection with the accompanying drawings wherein are set forth, by way of illustration and example, a certain embodiment of this invention.

DESCRIPTION OF THE DRAWINGS

FIG. 2 is a side elevational view of the strip reel and printing apparatus.

FIG. 3 is an enlarged, fragmentary front elevational view of the strip reel and printing apparatus.

FIG. 7 is a sectional view taken along line 7—7, FIG. 1.

FIG. 12 is a fragmentary, front elevational view of the printing mechanism showing an impression wheel and bracket swung inwardly toward a plate wheel and in an engaged position.

FIG. 13 is a fragmentary front elevational view of the printing mechanism and showing the impression wheel and bracket swung outwardly of the plate wheel in a disengaged position.

FIG. 14 is a fragmentary view of a dancer tube.

DESCRIPTION OF THE PREFERRED EMBODIMENT

Figure 1:
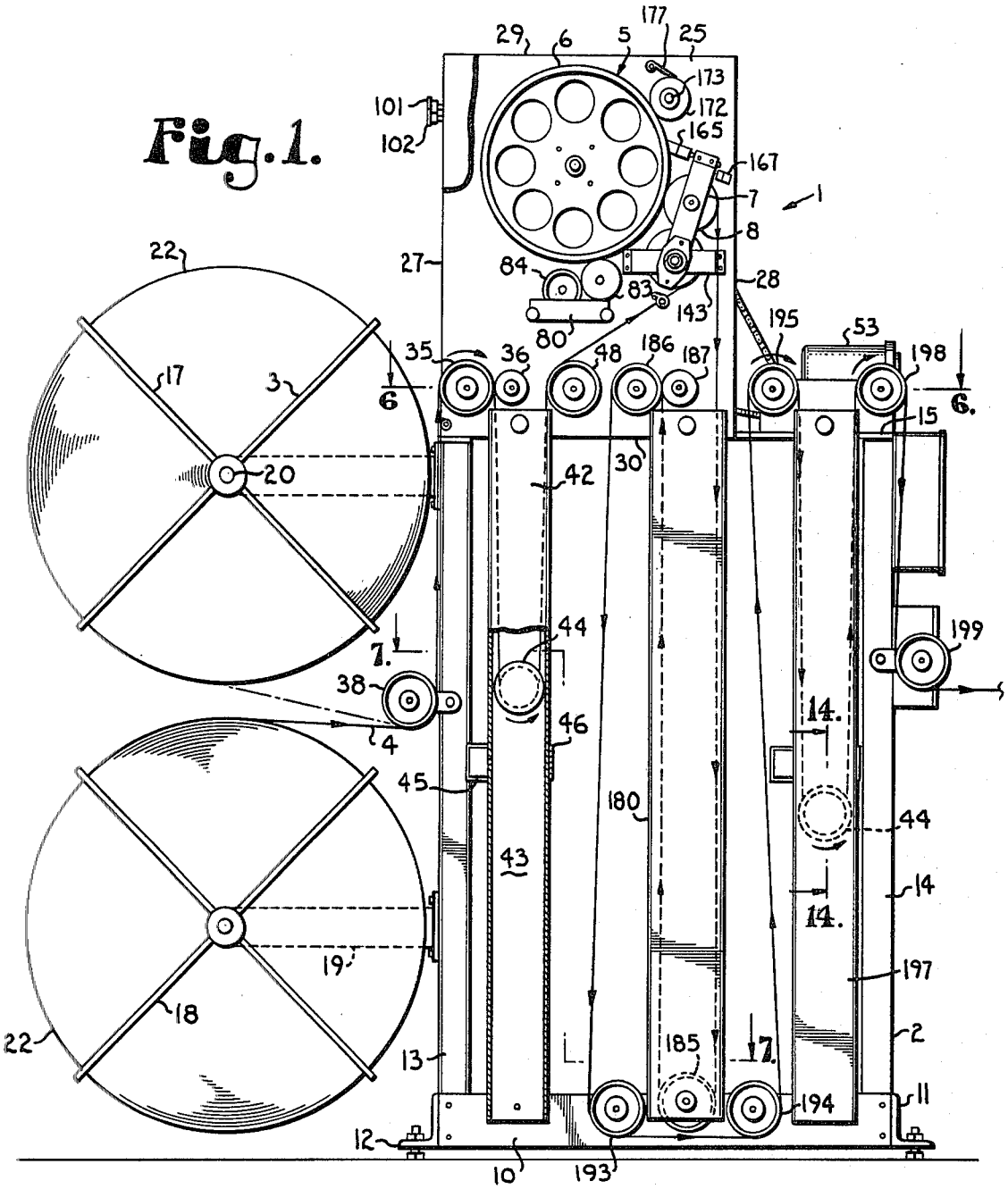
FIG. 1 is a front elevational view of a strip reel and printing apparatus embodying the present invention.

As required, a detailed embodiment of the present invention is disclosed herein, however, it is to be understood that the disclosed embodiment is merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1, FIGS. 1 and 2 generally indicates a strip reel and printing apparatus embodying the present invention and including a frame 2 with reel holders 3 mounted to the frame 2 for feeding in a strip 4 of headband material. Various rollers and slack take-up devices pull upon and exert constant tension upon the strip 4 for feeding into and out of a printing mechanism 5 including a plate wheel 6 and printer driving means operatively connected thereto for rotation of the plate wheel 6 at a constant speed. Rotation angle sensors indicate rotary travel of the plate wheel 6 and include stop and start switches. The switches cause actuation and movement of a swing mounted arm 7 holding an impression wheel 8 into and out of printing contact with the plate wheel 6. The plate wheel 6 turns at a constant speed and the strip 4 alternately starts and stops travel through the swing mounted arm 7 and impression wheel 8, thereby printing the strip 4 at intervals. The printing interval is completely adjustable between the circumferential length of the plate wheel 6 and the length of a selected character on the plate wheel.

In the illustrated example, the frame 2 includes spaced base members 10 secured to opposite frame end members 11 with adjustable, floor engaging feet 12 thereon. Spaced upright side beams 13 and 14 are secured to the respective end members 11 and support a horizontal top beam 15 extending partway between the side beams 13 and 14.

The exemplary reel holders 3 are top and bottom holders 17 and 18 with each supported by an elongated horizontally extending arm 19 secured to the frame side beam 13 and having an end shaft 20 rotatably mounting a reel wheel 21. A reel 22 of coiled headband material is held on the reel wheel 21 for feeding through the printing mechanism 5 and subsequent application to a tablet.

The headband material is applied to a tablet through the operation of a tablet machine such as shown in U.S. Pat. No. 3,668,037, assigned to the Brackett Stripping Machine Company, Inc., the disclosure of which is incorporated herein by reference.

The exemplary print wheel and stripping apparatus 1 includes two reel holders 17 and 18 whereby headband material of a different color, width, or the like can be prepositioned for use and the headband strip thereof from either reel holder 17 or 18 fed into the printing apparatus 5.

The printing mechanism 5 is mounted on spaced upright plates 25 and 26 secured to and extending upwardly from the frame side beams 13 and 14 and the horizontal top beam 15. The plates 25 and 26 respectively have opposite side margins 27 and 28 and top and bottom margins 29 and 30. The spacing of the plates 25 and 26 provides a partial enclosure 21 therebetween.

Figure 5:
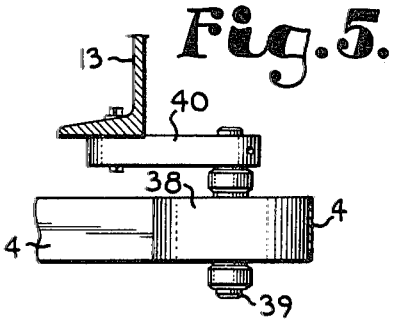
FIG. 5 is a fragmentary view of a pulley and arm in the feed path of a headband strip.
Figure 15:
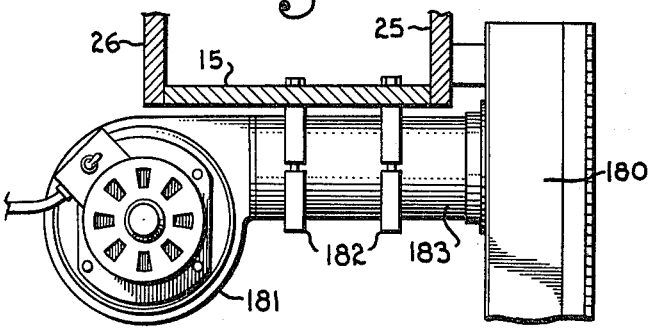
FIG. 15 is an enlarged, fragmentary view of a heater blower and a portion of a dryer tube.
Figure 4:
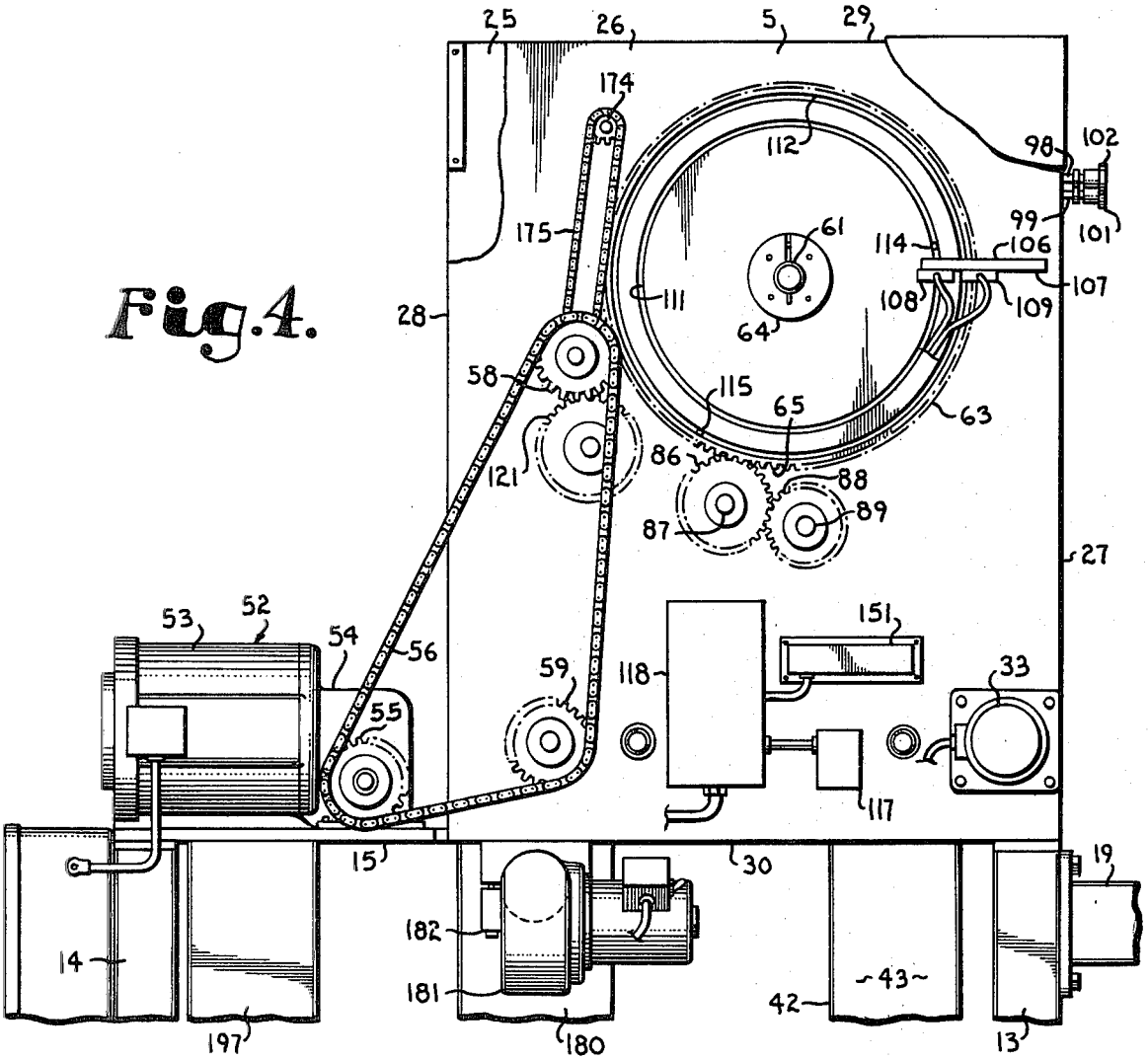
FIG. 4 is an enlarged rear elevational view of the strip reel and printing apparatus.
Figure 6:
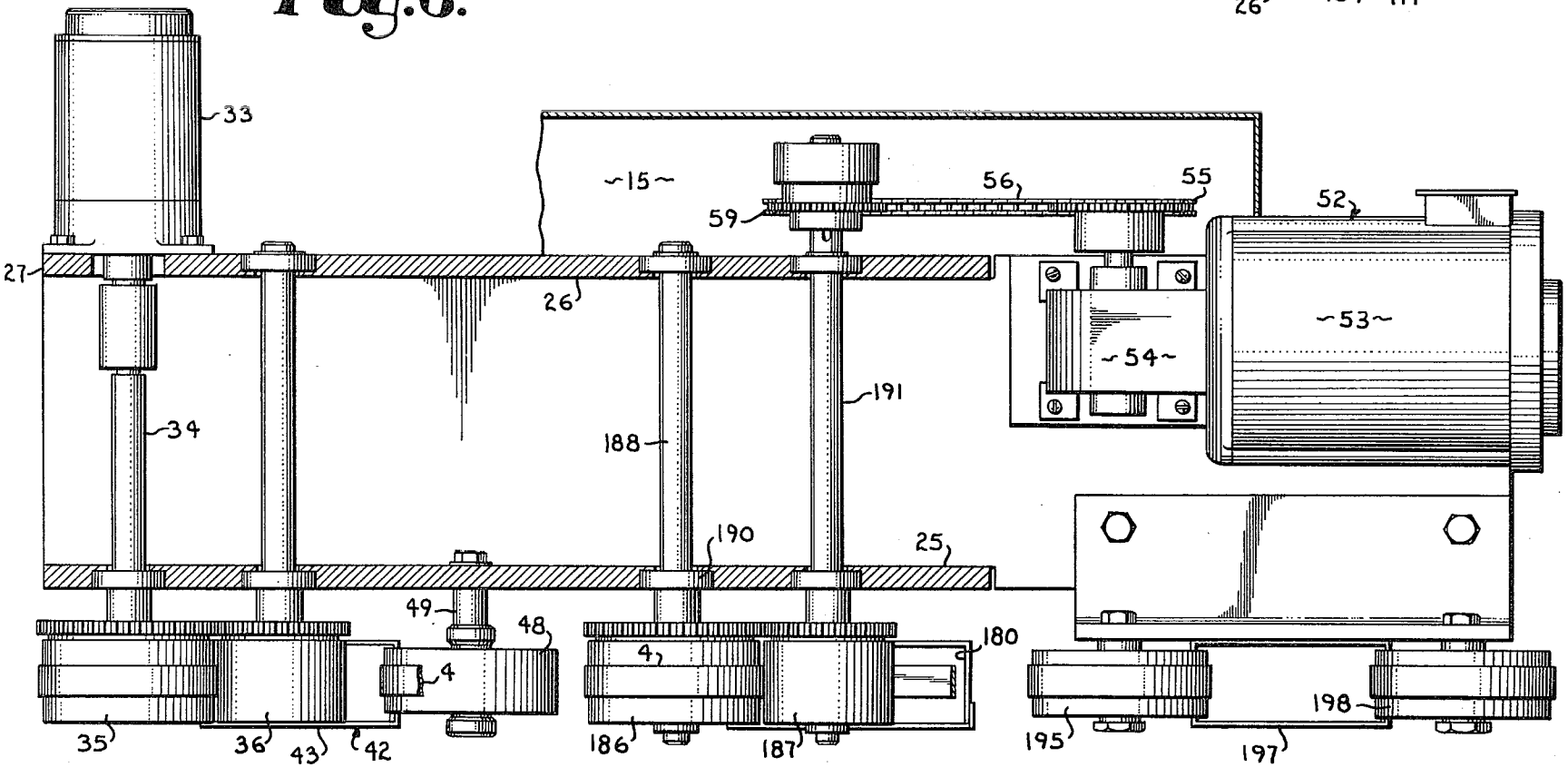
FIG. 6 is a sectional view taken long lines 6—6, FIG. 1.

A driving means is provided to pull the strip 4 from the selected reel 22, and in the illustrated example, an electrical motor 33, FIGS. 2 and 4, is mounted to the plate 26 and has a shaft 34, FIG. 6, extending through the plates 25 and 26 to power a roller 35 to drive a roller 36 and provide a pinch roller arrangement pulling the strip 4. As the strip 4 pulls off the reel 22, travel is around a pulley 38 rotatably mounted on a shaft 39 extending from a bracket 40 secured to the side beam 13, FIG. 5.

The printing mechanism 15 is an interval printer and alternately starts and stops movement of the strip 4. To accommodate interval movement of the strip 4, a take-up means 42, such as in the form of a dancer tube 43 is provided. The dancer tube 43 is an elongate member of substantially rectangular interior and exterior configuration and has an internal, flanged, dancer ring 44, FIG. 1, of cylindrical shape around which the strip 4 runs. As shown in FIG. 1, the weight of the dancer ring 44 causes the strip 4 to be drawn downwardly in the dancer tube 43. Travel of the strip 4 through the printer mechanism causes the ring 44 to move upwardly. The ring 44 thus moves upwardly and downwardly within the tube 43 and exerts constant tension on the strip 4. A photoelectric cell 45 and target 46 positioned approximately half-way on the length of the dancer tube 43 is connected by appropriate electrical wiring to send on and off signals to the motor 33 to intermittently cause operation thereof and driving of the pinch rollers 35 and 36 in order to maintain a supply of the headband strip 4 in the dancer tube 43.

A pulley 48 is rotatably mounted on a shaft 49 and located for return of the strip 4 from the dancer tube 43 and feeding into the printer mechanism 5.

In the illustrated example, the printer mechanism 5 comprises the plate wheel 6, swing mounted arm 7 and impression wheel 8 as aforementioned together with a printing mechanism driving means 52, FIG. 4. The driving means 52 includes a motor 53, such as electrically powered, suitably mounted on the horizontal top beam 15 with a gear reduction unit 54 joined thereto for rotatably driving a first sprocket wheel 55. The first sprocket wheel 55 drives a chain 56 which in turn rotatably powers a second sprocket wheel 58 which causes rotation of the plate wheel 6 and a third spocket wheel 59 which drives a second pinch roller arrangement mentioned below. The plate wheel 6 forms a part of a double wheel arrangement including the plate wheel 6 located adjacent one plate 25 and rotatably mounted on a main drive shaft 61 suitably journaled in bearings 62. A main drive wheel 63 is concentrically mounted on the other end of the shaft 61 adjacent the plate 26, as by suitable keying between the shaft 61 and the main drive wheel hub 64. The main drive wheel 63 has a plurality of gear teeth 65 therearound.

Figure 10:
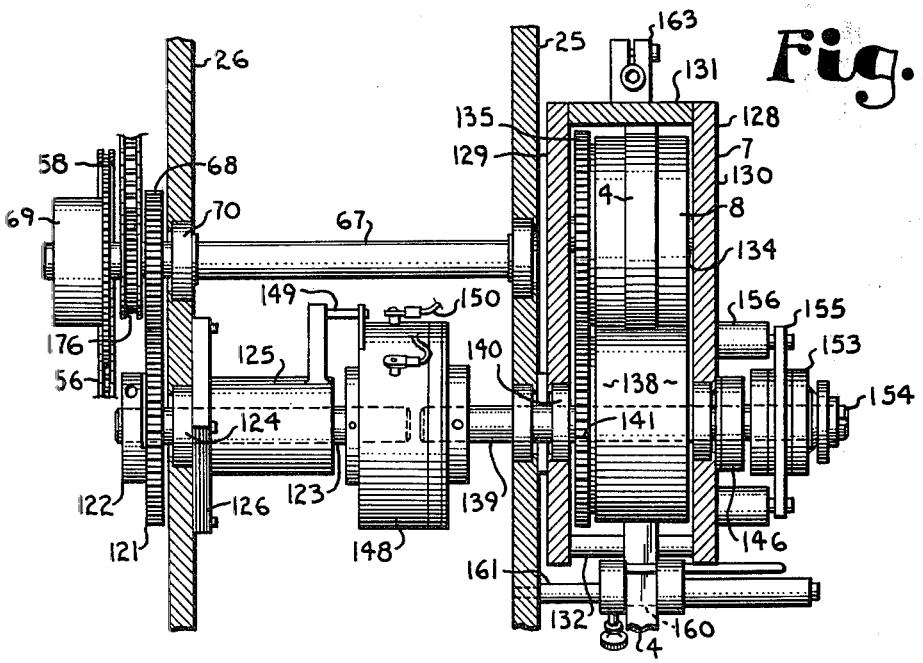
FIG. 10 is an enlarged sectional end view showing a clutch and driver connecting portions of the printing mechanism.

The second sprocket wheel 58 is mounted upon a shaft 67, FIG. 10, as by keying or the like, and spaced from the plate 26 a sufficient distance to permit mounting of drive gears 68 on the common shaft 67 which are affixed thereto as by a hub clamp 69. The shaft 67 rides in suitable bearings 70. The drive gear 68 meshes with the teeth 65 of the main drive wheel 63 to provide powered rotation of the plate wheel 6.

The remote end of the main drive shaft 61 has a flange 72 secured thereto to which the plate wheel 6 is removably mounted, as by bolts 73. A central wheel portion 74 of the plate wheel 6 has a plurality of lightening holes 75 arranged therearound and an outer rim or felly 76 is secured, as by welding, to the central wheel portion 74. A printing plate 78, such as of rubber or suitable synthetic rubbery material, is adhered to the outer rim or felly 76. The plate wheel 6 is easily removable from the flange 72 by backing out the bolts 73 for cleaning and changing the printing plate 78.

To apply ink to the rotary printing plate 78, a fountain tray 80 is positioned adjacent a bottom of the plate wheel 6 and removably mounted to the plate 25 as by bolts 81 with knob heads 82 for ease of grasping. The fountain tray 80 holds a quantity of ink and may be readily removed and replaced for application of different ink colors. Fountain rollers 83 and 84 transfer ink from the fountain tray 80 to the printing plate 78 and are driven by a gear means off the main drive wheel 63.

In the illustrated example, FIG. 4, a first fountain roller drive gear 86 is mounted on a shaft 87 and has a plurality of teeth in intermeshing engagement with the teeth 65 of the main drive wheel 63. A second fountain roller drive gear 88 is sleeved on the end of a shaft 89. The first fountain roller drive gear 86 drives the fountain roller 83 and the second fountain roller drive gear 88 drives the fountain roller 84.

Figure 9:
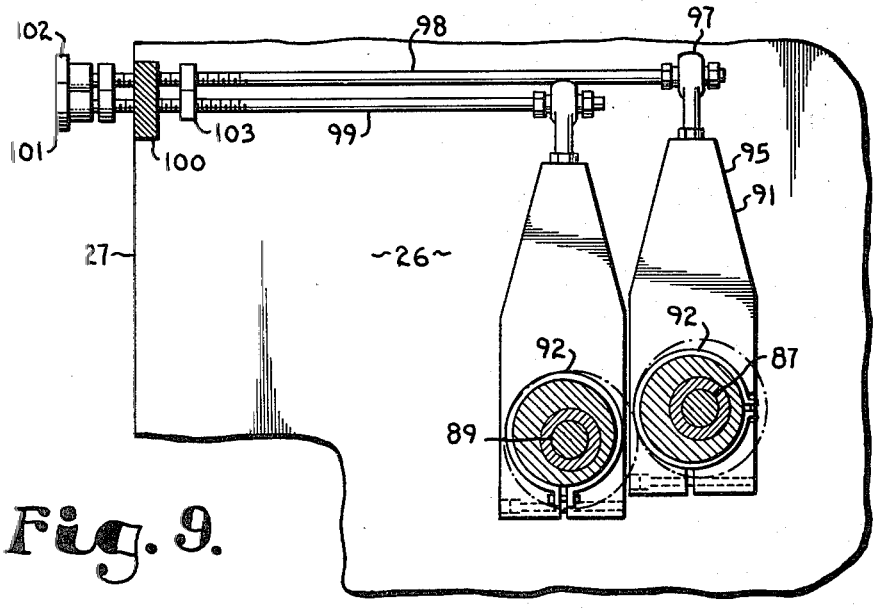
FIG. 9 is a fragmentary, sectional view taken along lines 9—9, in FIG. 8.
Figure 11:
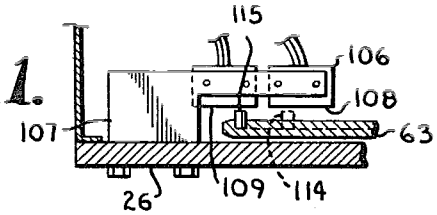
FIG. 11 is an enlarged fragmentary view showing a start and stop switch means of the printing mechanism.
Figure 8:
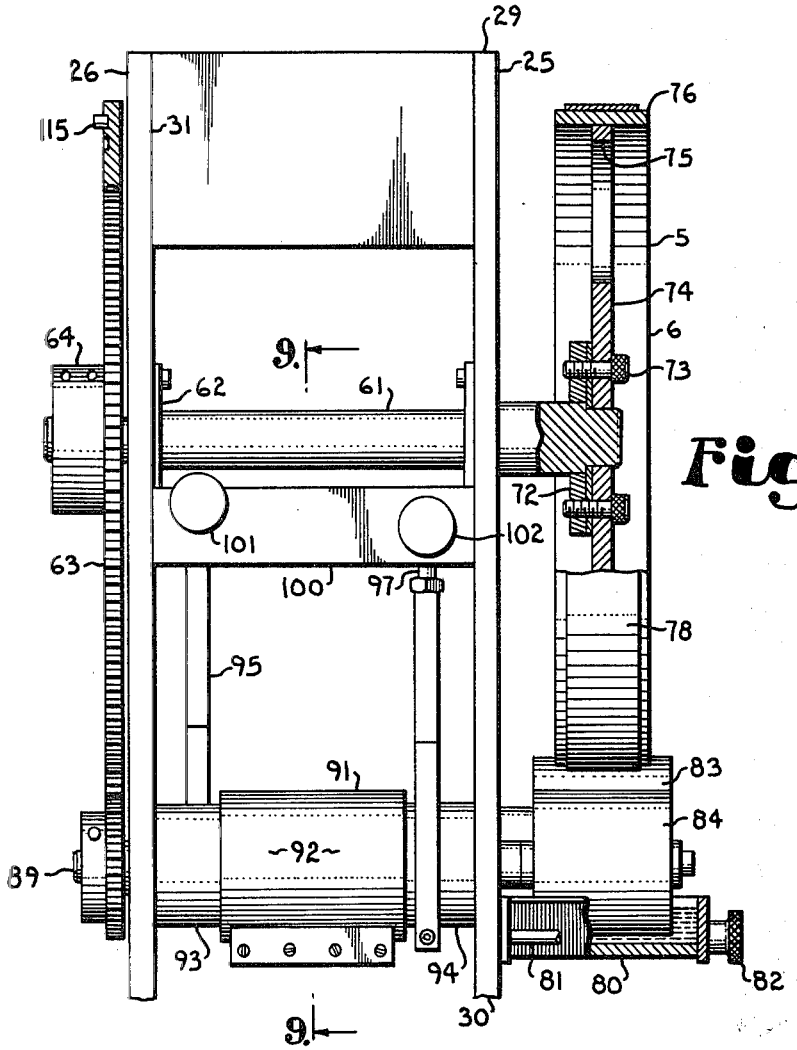
FIG. 8 is an enlarged, fragmentary end elevational view of the printing mechanism portion of the strip reel and printing apparatus.

The amount of ink application is controlled through an eccentric means 91, FIG. 8, on each shaft 87 and 89, FIG. 9, wherein each of the shafts 87 and 89 is comprised of two half shafts and a connecting housing 92 receiving confronting ends of the half shafts. Shaft housing portions 93 and 94 extend into each of the connecting housings 92 and a lever arm 95 is connected to the shaft housing portion 94 for the shaft 89. A second lever arm 95 is connected to the shaft housing portion 93 for the shaft 87 to move one shaft half with respect to the other shaft half.

Eye connectors 97 extend upwardly from the lever arms 95 and respectively connect to draw arms 98 and 99 for manual movement of the respective lever arms 95. The ends of the draw arms 98 and 99 are threaded and extend through a frame cross member 100 and have respective knobs 101 and 102 screw mounted on the free ends thereof. Lock nuts 103 on each of the draw arms 98 and 99 provide stops for limiting movement of the lever arms 95.

Longitudinal movement of the draw arms 98 and 99 respectively moves the first and second fountain rollers 83 and 84 from side to side to squeeze rollers 83 and 84 in varying amounts of pressure to control the amount of ink applied to the printing plate 78.

A stop and start switch means 106 is associated with the main drive wheel 61 and senses the rotation angle thereof as the main drive shaft 61, main drive wheel 63 and printing plate 6 rotate. In the illustrated example, the start and stop switch means 106 is mounted to the plate 26 as by an L-shaped bracket 107 and extend over a portion of the main drive wheel 63. The L-shaped bracket 107 holds magnetically actuated start and stop switches 108 and 109 with internal switch circuitry responsive to passage of a magnet thereunder. The main drive wheel 63 has inner and outer grooves or channels 111 and 112 extending concentrically about the outer surface of the wheel 63 and respectively aligned with start and stop switches 108 and 109. A start magnet 114 is magnetically engaged in the inner groove or channel 111 and a stop magnet 115 is magnetically engaged in the outer groove or channel 112.

Electrical power is provided to the start and stop switches 108 and 109 through wiring (not shown) through a voltage step down transformer 117 connected to a circuit box 118.

The start and stop switches 108 and 109 are electrically connected to control movement of the swing mounted arm 7 and contact of the impression wheel 8 with the plate wheel 6. In the illustrated example, the drive chain 56 causes the rotation of the drive gear 68, FIG. 10, which has teeth engaged with the gear teeth of an impression wheel drive gear 121. The drive gear 121 is suitably mounted, as by a clamp gear hub 122, to a half shaft 123 extending through the plate 26 and rotatably supported by bearing 124 and a bearing support bracket 125 connected to the plate 26 by a flange 126.

The exemplary swing mounted arm 7 forms a bracket 128 having spaced arm members 129 and 130 connected by upper and lower cross members 131 and 132. The impression wheel 8 is mounted on a shaft 134, FIG. 10, extending between the arm members 129 and 130 and adjacent the upper cross member 131. An impression wheel gear 135 is mounted on the portion of the shaft 134 between the impression wheel 8 and the arm member 129. The impression wheel 8 and impression wheel gear 135 are mounted on the shaft 134 such that driving of the gear 135 causes the impression wheel 8 to rotate.

A pinch roller 138 is rotatably mounted in the bracket 128 adjacent the lower cross member 132 and is nonrotatably affixed to a half shaft 139 coaxially positioned relative to the half shaft 123. The half shaft 139 extends through the arm members 129 and 130 and plate 25 and is suitably mounted therein as by bearings 140. Sleeved on the half shaft 139 between the pinch roller 138 and the arm member 129 is a tension roller gear 141 in intermeshing engagement with the impression wheel gear 135 to drive the impression wheel 8.

To suitably support the bracket 128 with the impression wheel 8 and associated driving members therein, the mounting bracket 143 is affixed to the plate 25 and includes spaced legs 144 and 145 connected to a center member 146 spaced a sufficient distance to accommodate the bracket 128 between the center member 146 and the plate 25.

A selective engagement/disengagement means such as an electromagnetic clutch 148 interconnects the half shafts 123 and 139 to selectively drive the impression wheel 8 and cause movement and printing of the headband strip 4. In the illustrated example, the electromagnetic clutch 148 is positioned at the confronting junction of the half shafts 123 and 139 and the housing thereof connected to the bearing support bracket 125 as by a pin 149. Suitable electrical lines 150 connect the electromagnetic clutch 148 to the circuit box 118 through a connector panel 151. Circuitry therein is arranged so that signals are received from the start and stop switches 108 and 109 whereby the start switch 108 transmits a signal to actuate the electromagnetic clutch 148 and connect the half shafts 123 and 139 in engaged or driving relation. Conversely, the stop switch 109 transmits a signal to the electromagnetic clutch 148 to disengage the half shaft 139 from the constantly turning half shaft 123 and thereby cease revolution of the impression wheel 8.

To cause the swing mounted arm 7 with bracket 128 to swing the impression wheel 8 into and out of engagement with the plate wheel 6, a drag clutch 153 is mounted on an outwardly projecting end portion 154 of the half shaft 139. Outwardly extending flanges 155 of the drag clutch 153 are connected, as by pins 156, to the arm member 130 of the bracket 128. The drag clutch 153 has internal frictional means reactive to the torque or rotation of the shaft end portion 154 whereby the drag clutch binds to cause the flanges 155 to swing in the rotational direction of the shaft end portion 154 and, through the connection of the pins 156, cause the bracket 128 to swing toward the plate wheel 6 upon initiation of rotation of the half shaft 139.

Upon the cessation of rotation of the shaft end portion 154, the off vertical center line weight of the impression wheel 8 relative to the pinch roller 138 causes the bracket 128 to swing clockwise and disengage the impression wheel 8 and strip 4 from the plate wheel 6. Swinging movement of the bracket 128 is substantially simultaneous with driving of the half shaft 139; i.e. when the electromagnetic clutch 148 connects the constantly driven half shaft 123 with the intermittently driven half shaft 139, the drag clutch 153 instantly senses rotation of the shaft and causes the bracket 128 to swing counterclockwise and engage the impression wheel 8 with the plate wheel 6. Conversely, upon disengagement of the electromagnetic clutch to stop driving of the half shaft 139 from the constantly driven half shaft 123, the bracket 128 simultaneously swings the impression wheel 8 away from the plate wheel 6.

A minor tension adjustment device 160 is mounted on an arm 161 extended outwardly of the plate 25 to position the adjustment device 160 in the path of the strip 4 as the strip enters the bracket 128. As shown in FIG. 12, the strip 4 goes around the outside of the pinch roller 138 and toward the inside of the impression wheel 8 for printing contact with the printing plate 78 affixed to the plate wheel 6. After printing, the strip 4 travels downwardly and through a dryer and other means described below.

To adjust the swinging travel of the bracket 128, a bifurcated projection 163, FIGS. 10, 12 and 13, extends upwardly from the upper cross member 131 and retains an adjustment pin 164. The adjustment pin 164 is screw threaded and movable through the projection 163 to abut a stop member 165 secured to the plate 25 and positioned between the upper portion of the bracket 128 and the plate wheel 6 to provide an inner stop or limit.

A second stop member 167 is affixed to the plate 25 on the other side of the bracket 128. A stop pin 168 secured to the arm member 129 abuts the stop member 167 upon swinging of the bracket 128 to a disengaged position. The inner stop or limit with the adjustment pin 164 and stop member 165 is adjustable to selectively limit the amount of inward travel of the impression wheel 8 and control the amount of printing pressure thereon.

In operation, the swing mounted arm 7 carries the impression wheel 8 toward and away from the plate wheel 6 in coordination with the operation of the electromagnetic clutch 148 to alternately print and move the strip 4 and cease printing and movement of the strip in response to the stop and start switches 108 and 109. The stop and start magnets 114 and 115 are selectively positionable on the main drive wheel 63 at selected rotation angles and in respective rotational registration with the stop and start switches 108 and 109 whereby intervals of printing on the strip 4 are selected in accordance with the placement of the stop and start magnets 114 and 115.

Because the plate wheel 6 is constantly rotating and ink is continually being applied to the wheel 6, a means for preventing excessive build-up of ink is provided. In the illustrated example, a wiper roller 172, FIG. 1, is mounted in contact with the plate wheel 6 and positioned adjacent the upper portion of the bracket 128. The wiper roller 172 is rotatably mounted on shaft 173 extending through the plates 25 and 26 and connected to a sprocket 174 positioned adjacent the main drive wheel 63. The sprocket 174 is rotatably driven by a connecting chain 175 driven from a third spocket 176 mounted on the shaft 67 and positioned between the second sprocket wheel 58 and the drive gear 68. As the wiper roller 172 is not driven by engagement with the plate wheel 6, wear on the printing plate 78 is avoided. Excess ink on the printing plate 78 is transferred to the wiper roller 72 and a scraper 177 secured to and extending from the plate 25 contacts the wiper roller 172 and removes excess ink as the roller 172 revolves.

From the printing mechanism 5, the tape 4 travels through a dryer tube 180 similar to the dancer tube 43 and mounted substantially vertically under the impression wheel 8. The dryer tube 180 is connected at a top end to the plate 25 and to the frame base member 10 at a bottom end. An electrical heater blower 181 is suspended, as by clamps 182, from the horizontal top beam 15 and includes a duct 183 connecting the heater blower 181 and routing heated air into the dryer tube 180. The strip 4 travels through the dryer tube 180, around a pulley 185 rotatably mounted at the lower end thereof and back upwardly through the tube 180 to pinch rollers 186 and 187.

The pinch roller 186 is rotatably mounted on a shaft 188 extending through the plates 25 and 26 and suitably supported by bearings 190. The pinch roller 187 is driven and mounted on a shaft 191 extending through the plates 25 and 26 with the third sprocket wheel 59 secured to the shaft remote end. The chain 56 extends around the third spocket wheel 59 for driving rotation of the pinch roller 187 and travel of the strip 4.

The strip travels between the pinch rollers 196 and 197 and downwardly between the first dancer tube 43 and the dryer tube 180 around a pulley 193 rotatably mounted on the frame base 10. The strip then travels along the frame base to a pulley 194 mounted adjacent the other side of the dryer tube and about a top pulley 195 mounted adjacent a second dancer tube 197, likewise having a dancer ring 44, photoelectric cell 45 and target 46 therein to accommodate slack in the strip 4. From the second dancer tube 197, the strip 4 passes around a pulley 198 at the top of the dancer tube 197 and then travels downwardly to a pulley 199 which directs the strip 4 to a tablet machine or other suitable headband strip using device.

Using the printer 1, strips of virtually any commonly used tablet length can be printed merely by adjusting the spacing of the stop and start magnets 114 and 115. If a strip length having a length, for example, of $8\frac{1}{2}$ inches is desired, the start magnet 114 is merely positioned on a selected line of radius to coincide with the desired print character and the stop magnet 115 positioned so that a linear distance of $8\frac{1}{2}$ inches on the printing plate 78 from the start print point is obtained. Thereafter, although the plate wheel 6 with the printing plate 78 thereon revolves constantly, the swing mounted arm 7 with impression wheel 8 and strip 4 swings into and out of engagement with the plate wheel 6 in accordance with the setting of the start and stop magnets 114 and 115. During the engaged cycle, the strip 4 is fed through the printing mechanism 5 and printed. Conversely, when in the disengaged cycle, the strip 4 is stopped and does not move through the printing mechanism 5.

The length of a selected line of print can be virtually any distance and the stop magnet 115 may even be removed so as to move the strip 4 through the printing mechanism 5 at a linear speed the same as the linear rotational speed of the plate wheel 6, thereby providing direct rotary printing.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A printer for strips of headband material comprising:

(a) a frame;

(b) a reel holder connected to said frame for feeding in a strip of headband material;

(c) a driven pulley wheel arrangement pulling said strip along a feed path;

(d) a first take-up tube extending upwardly and having an upward and downward traveling wheel weight therein to take-up slack in said strip;

(e) a printing mechanism located on said frame downstream of said first take-up tube and including a plate wheel rotatably mounted in said feed path;

(f) a printing mechanism driving means including a motor operably connected to a main drive wheel, said main drive wheel being connected to said plate wheel by a main drive shaft;

(g) rotation angle sensors associated with said main drive wheel including magnetically actuated start and stop switches mounted on said frame adjacent said main drive wheel and extending over a portion thereof and start and stop magnets selectively positionable on said main drive wheel at selected rotation angles and in respective rotational registration with said start and stop switches;

(h) ink applicator wheels and an ink tray mounted on said frame to apply ink to said plate wheel;

(i) a swing mounted bracket mounted adjacent said plate wheel and carrying a rotatably mounted pinch wheel in contact with an impression wheel in the feed path of said strip, said bracket being selectively swingeable toward and away from said plate wheel to move said impression wheel and said strip in and out of printing contact therewith;

(j) an impression wheel driving means including a secondary drive wheel driven by said printing mechanism driving means, said pinch wheel being connected to said secondary drive wheel by a secondary drive shaft having an electromagnetic clutch therein to selectively cause rotation of said impression wheel in response to actuation of said start and stop switches;

(k) a drag clutch mounted on said bracket and connected to said secondary drive shaft to cause swinging of said bracket toward said plate wheel and printing of said strip simultaneously with initiation of rotation of said impression wheel and swinging of said bracket from said plate wheel simultaneously with stopping of rotation of said impression wheel whereby intervals of printing on said strip are selected in accordance with the setting of said start and stop magnets;

(l) a drier tube and heater blower mounted to said frame in the strip feed path downstream of said printing mechanism; and (m) a second take-up tube extending upwardly and having an upward and downward traveling wheel weight therein to take-up slack in said strip.

2. A printing mechanism for a headband strip printer comprising:

(a) a frame;

(b) a plate wheel with a printer driving means operably connected thereto for rotation of said plate wheel at a constant speed;

(c) rotation angle sensors indicating rotation of said plate wheel and including start and stop switches; said switches being adjustable for setting in selected rotation angles of said plate wheel;

(d) a swing mounted arm rotatably holding an impression wheel situated in a feed path of said strip, said arm being mounted on said frame adjacent said plate wheel for swinging said impression wheel and said strip in and out of printing contact with said plate wheel;

(e) an impression wheel driving means alternately starting and stopping rotation of said strip in response to actuation of said start and stop switches;

(f) a means selectively swinging said arm and said impression wheel into printing contact with said plate wheel simultaneously with the start of rotation of said impression wheel and out of printing contact simultaneously with the stop of rotation of said impression wheel whereby intervals of printing on said strip are selected in accordance with the setting of said start and stop switches;

(g) said printer driving means including a main drive gear interconnected to said plate wheel by a main drive shaft;

(h) said rotation angle sensors including start and stop magnetically sensitive switches extending over a portion of said main drive gear and start and stop magnets selectively positioned on said main drive gear in respective rotational registration with said magnetically sensitive switches; and (i) said impression wheel driving means including an electromagnetic clutch electrically connected to said start and stop switches and engageable and disengageable to respectively start and stop rotation of said impression wheel.

3. The printing mechanism set forth in claim 2 wherein:

(a) said impression wheel driving means includes an impression wheel drive gear interconnected with said impression wheel by respective impression wheel drive half shafts supported in confronting relation; and (b) said electromagnetic clutch extends between and connects said half shafts.

4. A printing mechanism for a headband strip printer comprising:

(a) a frame;

(b) a plate wheel with a printer driving means including a main drive gear connected to said plate wheel by a main drive shaft for rotation of said plate wheel at a constant speed;

(c) rotation angle sensors indicating rotation of said plate wheel and including start and stop magnetically sensitive switches and start and stop magnets selectively positionable on said main drive gear in respective rotational registration with said magnetically sensitive switches;

(d) a swing mounted arm rotatably holding an impression wheel situated in a feed path of said strip, said arm being mounted on said frame adjacent said plate wheel for swinging said impression wheel and said strip in and out of printing contact with said plate wheel;

(e) an impression wheel driving means alternately starting and stopping rotation of said strip in response to actuation of said start and stop switches; and (f) an electromagnetic clutch electrically connected to said start and stop switches and engageable and disengageable for selectively swinging said arm and said impression wheel into printing contact with said plate wheel simultaneously with the start of rotation of said impression wheel and out of printing contact simultaneously with the stop of rotation of said impression wheel whereby intervals of printing on said strip are selected in accordance with the setting of said start and stop switches.

* * * * *